US009458679B2

(12) United States Patent
Turner et al.

(10) Patent No.: US 9,458,679 B2
(45) Date of Patent: Oct. 4, 2016

(54) APPARATUS AND METHOD FOR DAMPING VIBRATION IN A DRILL STRING

(75) Inventors: William Evans Turner, Durham, CT (US); Mark Hutchinson, Meriden, CT (US); Dirk Bosman, Dubai (AE); Mark Ellsworth Wassell, Houston, TX (US); Carl Allison Perry, Middletown, CT (US); Martin E. Cobern, Cheshire, CT (US)

(73) Assignee: APS Technology, Inc., Wallingford, CT (US)

( * ) Notice: Subject to any disclaimer, the term of this patent is extended or adjusted under 35 U.S.C. 154(b) by 440 days.

(21) Appl. No.: 13/041,863

(22) Filed: Mar. 7, 2011

(65) Prior Publication Data

US 2012/0228028 A1 Sep. 13, 2012

(51) Int. Cl.

| | |
|---|---|
| ***E21B 17/07*** | (2006.01) |
| ***E21B 44/00*** | (2006.01) |
| ***E21B 17/10*** | (2006.01) |

(52) U.S. Cl.

CPC ..... *E21B 17/07* (2013.01); *E21B 17/10* (2013.01); *E21B 44/00* (2013.01)

(58) Field of Classification Search

CPC ..... E21B 44/00; E21B 7/24; E21B 7/04; E21B 7/06; E21B 7/046; E21B 44/02; E21B 7/00; E21B 17/10; E21B 7/10

USPC ..... 175/56, 24, 40

See application file for complete search history.

(56) References Cited

U.S. PATENT DOCUMENTS

| | | | |
|---|---|---|---|
| 3,918,519 | A | 11/1975 | Cubberly |
| 3,947,008 | A | 3/1976 | Mullins |
| 4,133,516 | A | 1/1979 | Jurgens |

(Continued)

FOREIGN PATENT DOCUMENTS

| | | | |
|---|---|---|---|
| WO | WO 92/07163 | A1 | 4/1992 |
| WO | WO 2009/030925 | A2 | 12/2009 |

OTHER PUBLICATIONS

For the American Heritage Dictionary definition: fully. (n.d.) American Heritage® Dictionary of the English Language, Fifth Edition. (2011). Retrieved Oct. 26, 2015 from http://www.thefreedictionary.com/fully.*

(Continued)

*Primary Examiner* — Blake Michener
*Assistant Examiner* — Wei Wang
(74) *Attorney, Agent, or Firm* — Baker & Hostetler LLP

(57) ABSTRACT

An apparatus and method for damping vibration, especially torsional vibration due to stick-slip, in a drill string, Sensors measure the instantaneous angular velocity of the drill string at one or more locations along the length of the drill string. One or more vibration damping modules are also spaced along the length of the drill string. When torsional vibration above a threshold is detected, the damping module imposes a reverse torque on the drill that dampens the torsional vibration. The reverse torque can be created by imparting a frictional resistance to the rotation of the drill string. The frictional resistance can be created externally, by extending friction pads from the damping module so that they contact the bore hole wall and drag along the bore hole as the drill string rotates, or internally by anchoring a housing mounted on the drill string to the wall of the bore hole and then imposing frictional resistance on a fluid, such as a magnetorheological fluid, flowing within the drill string.

36 Claims, 10 Drawing Sheets

(56) References Cited

U.S. PATENT DOCUMENTS

| | | | | |
|---|---|---|---|---|
| 4,427,079 | A | 1/1984 | Walter | |
| 4,647,853 | A | 3/1987 | Cobern | |
| 4,761,889 | A | 8/1988 | Cobern et al. | |
| 4,779,852 | A | 10/1988 | Wassell | |
| 4,813,274 | A | 3/1989 | DiPersio et al. | |
| 4,894,923 | A | 1/1990 | Cobern et al. | |
| 5,034,929 | A | 7/1991 | Cobern et al. | |
| 5,133,419 | A | 7/1992 | Barrington | |
| 5,251,708 | A | 10/1993 | Perry et al. | |
| 5,382,373 | A | 1/1995 | Carlson et al. | |
| 5,560,439 | A * | 10/1996 | Delwiche et al. | 175/325.1 |
| 5,582,260 | A * | 12/1996 | Murer et al. | 175/76 |
| 5,816,344 | A | 10/1998 | Turner | |
| 5,833,541 | A | 11/1998 | Turner et al. | |
| 5,927,409 | A | 7/1999 | Turner | |
| 5,931,000 | A | 8/1999 | Turner et al. | |
| 6,102,681 | A | 8/2000 | Turner | |
| 6,105,690 | A | 8/2000 | Biglin, Jr. et al. | |
| 6,123,561 | A | 9/2000 | Turner et al. | |
| 6,134,892 | A | 10/2000 | Turner et al. | |
| 6,257,356 | B1 | 7/2001 | Wassell | |
| 6,378,558 | B1 | 4/2002 | Pohl et al. | |
| 6,568,470 | B2 | 5/2003 | Goodson et al. | |
| 6,714,138 | B1 | 3/2004 | Turner | |
| 6,916,248 | B1 | 7/2005 | Burgess | |
| 7,021,406 | B2 | 4/2006 | Zitha | |
| 7,032,670 | B2 | 4/2006 | Zitha | |
| 7,036,612 | B1 | 5/2006 | Raymond et al. | |
| 7,219,752 | B2 | 5/2007 | Wassell | |
| 7,287,604 | B2 | 10/2007 | Aronstam | |
| 7,327,634 | B2 | 2/2008 | Perry | |
| 7,389,830 | B2 | 6/2008 | Turner | |
| 7,654,344 | B2 | 2/2010 | Haughom | |
| 7,681,663 | B2 | 3/2010 | Cobern | |
| 7,748,474 | B2 | 7/2010 | Watkins | |
| 8,011,452 | B2 * | 9/2011 | Downton | 175/76 |
| 8,205,686 | B2 * | 6/2012 | Beuershausen | 175/57 |
| 8,978,782 | B2 * | 3/2015 | Martinez et al. | E21B 47/024 175/40 |
| 2006/0215491 | A1 | 9/2006 | Hall | |
| 2007/0289778 | A1 | 12/2007 | Watkins | |

OTHER PUBLICATIONS

Chen, S.L., "Field Investigation of the Effects of Stick-Slip, Lateral and Whirl Vibrations on Roller Cone Bit Performance," SPE 56439, presented at the 58.sup.th SPE ATCE, Houston, Oct. 3-6, 1991.

Dykstra, M.W., "Experimental Evaluations of Drill Bit and Drill String Dynamics," SPE 28323, presented at the 61.sup.st SPE ATCE, New Orleans, Sep. 25-28, 1994.

Spencer Jr., B.F., "Phenomenological Model of a Magnetorheological Damper," Journal of Engineering Mechanics, ASCE, 123 230-238, 1997.

Turner, W.E., "New Isolator for Controlling BHA Vibrations," Energy Week Conference, Houston, Jan. 27, 1997.

Warren, T.M., "Shock Sub Performance Tests," IADC/SPE 39323, presented at the 1998 IADC/SPE Drilling Conference, Dallas, Mar. 3-6, 1998.

Harvey, P., "The Design of Steerable Systems to Minimize the Adverse Effects of Motor Imbalance and Drillstring Forces," SPE 22565, presented at the 66.sup.th SPE ATCE, Dallas, Oct. 6-9, 1999.

"Magnetic Ride Control," GM Tech Links, 4:1, pp. 1-2, Jan. 2002.

"International Search Report", International Preliminary Examining Authority, mailed Jun. 8, 2012 PCT/US2012/0026723, 2 pages.

"Written Opinion", International Preliminary Examining Authority, mailed Jun. 8, 2012 PCT/US2012/0026723, 3 pages.

* cited by examiner

APPARATUS AND METHOD FOR DAMPING VIBRATION IN A DRILL STRING

FIELD OF THE INVENTION

The present invention relates to underground drilling, and more specifically to a system and a method for damping vibration, and especially torsional vibration, in a drill string drilling into an earthen formation.

BACKGROUND OF THE INVENTION

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface to the bottom of the bore.

The drill bit is rotated so that it advances into the earth, thereby forming the bore. In rotary drilling, the drill bit is rotated by rotating the drill string from the surface. Piston-operated pumps on the surface pump high-pressure fluid, referred to as "drilling mud," through an internal passage in the drill string and out through the drill bit. The drilling mud lubricates the drill bit, and flushes cuttings from the path of the drill bit. In the case of motor drilling, the flowing mud also powers a drilling motor, commonly referred to as a "mud motor," which turns the bit, whether or not the drill string is rotating. The mud motor is equipped with a rotor that generates a torque in response to the passage of the drilling mud therethrough. The rotor is coupled to the drill bit so that the torque is transferred to the drill bit, causing the drill bit to rotate. The drilling mud then flows to the surface through an annular passage formed between the drill string and the surface of the bore.

A drill string may experience various types of vibration. "Axial vibration" refers to vibration in the direction along the drill string axis. "Lateral vibration" refers to vibration perpendicular to the drill string axis. Two sources of lateral vibration are "forward" and "backward," or "reverse," whirl. Torsional vibration is also of concern in underground drilling, and is usually the result of what is referred to as "stick-slip." Stick-slip occurs when the drill bit, or lower section of the drill string, momentarily stops rotating (i.e., "sticks") while the drill string above continues to rotate, thereby causing the drill string to "wind up," after which the stuck element "slips" and rotates again. Often, the bit will over-speed as the drill string unwinds. Another possible outcome is the when the slip ends, a rebound motion will cause part of the drill string to rotate counterclockwise, which may cause one or more of the threaded joints between the drill string sections to uncouple.

Systems currently on the market, such as APS Technology's Vibration Memory Module™, determine torsional vibration due to stick-slip by measuring and recording the maximum and minimum instantaneous rotations per minute ("RPM") over a given period of time, such as every four seconds, based on the output of the magnetometers. The amplitude of torsional vibration due to stick-slip is then determined by determining the difference between and maximum and minimum instantaneous rotary speeds of the drill string over the given period of time. Preferably, root-mean-square and peak values for the axial, lateral and torsional vibrations are recorded at predetermined intervals, such as every four seconds. The amplitudes of the axial, lateral and torsional vibration may be transmitted to the surface, e.g., via mud pulse telemetry, or stored downhole for subsequent analyses.

Unfortunately, although the existence of harmful torsional vibration, and in particular "stick-slip", can be detected, there is currently no effective method for damping such vibration. Consequently, a need exists for an apparatus and method for damping vibration in a drill string, especially torsion vibration due to stick-slip.

SUMMARY

The current invention provides an apparatus and method for reducing drill string torsional vibration, including torsional vibration due to stickslip. According to the invention, a torsional damping force (i.e., reverse torque) can be applied to the drill string, for example, by interacting with the borehole wall or by inducing internal rotational fluid resistance, and thereby limiting the maximum angular velocity of the drill string.

The invention encompasses a method of damping torsional vibration in a drill string having a drill bit for drilling a bore hole through an earthen formation. The method comprises the steps of (i) applying a torque to the drill string in a first rotational direction so as to cause the drill string to rotate in the first rotational direction, whereby the drill bit drills the bore hole into the earthen formation, (ii) sensing the value of a parameter associated with the rotation of the drill string that is indicative of the presence of torsional vibration in the drill string, (iii) comparing the value of the parameter to the first threshold, and (iv) applying a reverse torque to the drill string when the value of the parameter exceeds the threshold, the reverse torque acting in a second rotational direction that is opposite to the first rotational direction to dampen the torsional vibration. In one embodiment, the reverse torque is applied to the drill string by imposing frictional resistance to the rotation of the drill string. In one example of this embodiment, the reverse torque is applied to the drill string by dragging a friction member around the wall of the bore hole. In another example of this embodiment, reverse torque is applied by increasing fluid frictional resistance to the rotation of the drill string.

The invention also encompasses an apparatus for damping torsional vibration in a drill string having a drill bit for drilling a bore hole through an earthen formation, comprising (i) means for applying a torque to the drill string in a first rotational direction so as to cause the drill string to rotate in the first rotational direction, whereby the drill bit drills the bore hole into the earthen formation, (ii) a sensor for sensing the value of a parameter associated with the rotation of the drill string that is indicative of the presence of torsional vibration in the drill string and (iii) means for applying a reverse torque to the drill string when the value of the parameter exceeds a first threshold. In one embodiment of the apparatus, the means for applying a reverse torque to the drill string comprises means for imposing frictional resistance to the rotation of the drill string in the first rotational direction sufficient to create the reverse torque that dampens the torsional vibration of the drill string. In one example of this embodiment, the reverse torque is applied to the drill string by dragging a friction member around the wall of the bore hole. In another example of this embodiment, reverse torque is applied by increasing fluid frictional resistance to the rotation of the drill string.

DETAILED DESCRIPTION OF ILLUSTRATIVE EMBODIMENTS

Figure 1:
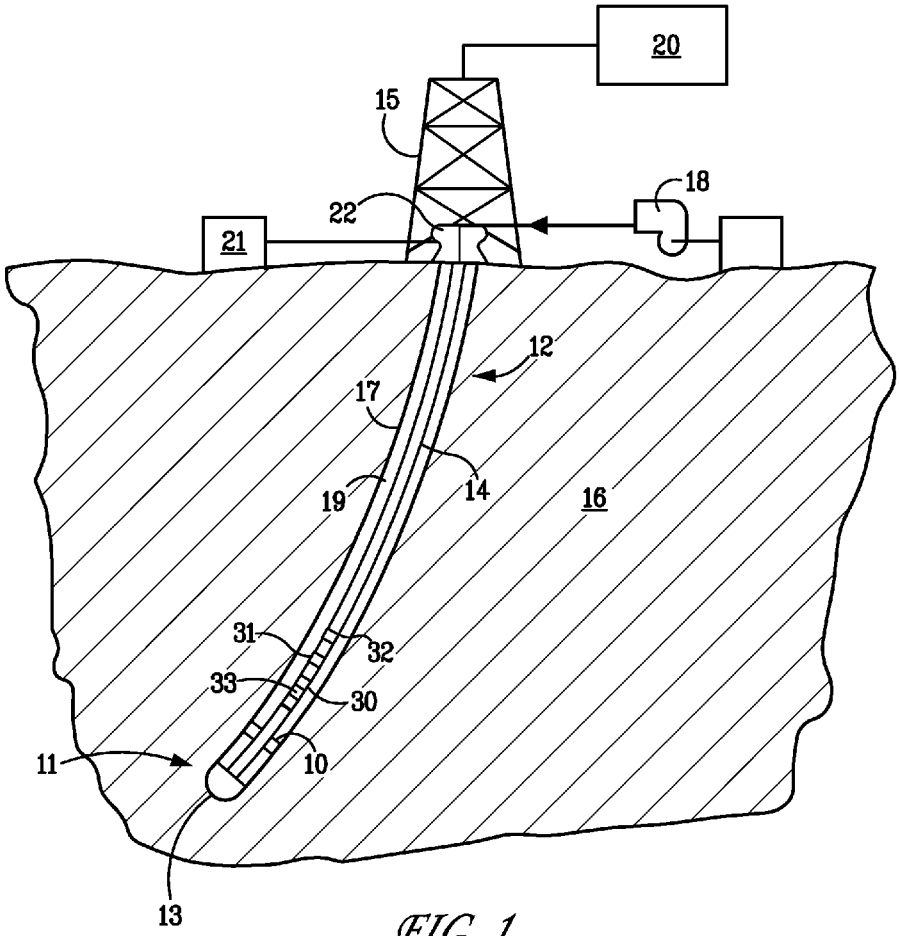
FIG. 1 is a view, partially schematic, of a drilling operation using a drill string incorporating a vibration damping module according to the current invention.

FIG. 1 depicts an underground drilling operation using a drill string 12 incorporating a torsional vibration damper module 10 according to the present invention. The drill string 12 includes a drill collar 14, a bottom hole assembly ("BHA") 11, which forms the down-hole end of the drill string, and a drill bit 13. According to the invention, the BHA also includes a vibration damping module 10. The drill bit 13 may be rotated by rotating the drill string 12. The drill string 12 is formed by connecting together relatively long sections of pipe, commonly referred to as "drill pipe." The length of the drill string 14 can be increased as the drill string 12 progresses deeper into the earth formation 16 by connecting additional sections of drill pipe to the drill string.

Torque to rotate the drill string 12 in a first rotational direction, e.g., clockwise when looking down on the drill string, may be applied by a motor 21 of a drilling rig 15 located on the surface. Drilling torque is transmitted from the motor 21 to the drill bit 13 through a turntable 22, a kelly (not shown), and the drill collar 14. The rotating drill bit 13 advances into the earth formation 16, thereby forming a bore hole 17. In another method, a mud motor (not shown) is incorporated into the bottom hole assembly 11 so that the drill bit 13 is rotated by the mud motor instead of, or in combination with, the rotation of the drill string 12.

Drilling mud is pumped from the surface, through an central passage in the drill string 12, and out of the drill bit 13. The drilling mud is circulated by a pump 18 located at the surface. The drilling mud, upon exiting through the drill bit 13, returns to the surface by way of an annular passage 19 formed between the drill collar 14 and the surface of the bore hole 17.

Operation of the drilling rig 15 and the drill string 12 can be controlled in response to operator inputs by a surface control system 20.

The BHA 11 can also include a measurement while drilling ("MWD") tool 30. The MWD tool 30 is suspended within the drill collar 14. The MWD tool 30 can include a mud-pulse telemetry system comprising a controller, a pulser, and a pressure pulsation sensor 31. The mud-pulse telemetry system can facilitate communication between the bottom hole assembly 11 and the surface.

The MWD tool 30 can also include a sensor 62 (shown in FIG. 2), preferably at least two sensors, for sensing rotation of the drill string 12. Such a sensor 62 may comprise three magnetometers that can be used to determine the relative orientation of the drill string about its axis, as described in U.S. Pat. No. 7,681,663 (Cobern), which is included herein by reference in its entirety. A signal processor 33 in the MWD tool 30 can process the measurements obtained from the sensors 62 to determine the substantially instantaneous angular velocity (i.e., the rate of change of MTF) of the drill string at the location of the sensors. The processor 33 compares the minimum and maximum instantaneous velocities of the drill string 4-4 12 measured by the sensors 62, with the difference being indicative of the amplitude of the torsional vibration, or "stick-slip." Preferably, the sensor 62 readings are sampled at a rate of 1000 Hz (i.e., once every millisecond) and filtered down to 250 Hz. The torsional vibration is determined by calculating the difference between the minimum and maximum angular velocities over a period of time.

Information and commands relating to the drilling operation can be transmitted between the surface and the damping module 10 using the mud-pulse telemetry system. The pulser of the mud-pulse telemetry system can generate pressure pulses in the drilling mud being pumped through the drill collar 14, using techniques known to those skilled in the art of underground drilling. A controller located in the down hole assembly can encode the information to be transmitted as a sequence of pressure pulses, and can command the pulser to generate the sequence of pulses in the drilling mud, using known techniques.

A strain-gage pressure transducer (not shown) located at the surface can sense the pressure pulses in the column of drilling mud, and generate an electrical output representative of the pulses. The electrical output can be transmitted to the surface control system 20, which can decode and analyze the data originally encoded in the pulses. The drilling operator can use this information in setting the drilling parameters.

A suitable pulser is described in U.S. Pat. No. 6,714,138 (Turner et al.), and U.S. Pat. No. 7,327,634 (Perry et al.), each of which is incorporated by reference herein in its entirety. A technique for generating, encoding, and decoding pressure pulses that can be used in connection with the mud-pulse telemetry system 321 is described in U.S. application Ser. No. 11/085,306, filed Mar. 21, 2005 and titled "System and Method for Transmitting Information Through a Fluid Medium," which is incorporated by reference herein in its entirety.

Pressure pulses also can be generated in the column of drilling mud within the drill string 12 by a pulser (not shown) located at the surface. Commands for the damper module 10 can be encoded in these pulses, based on inputs from the drilling operator. According to one aspect of the current invention, a pressure pulsation sensor 31 in the bottom hole assembly 11 senses the pressure pulses transmitted from the surface, and can send an output to the processor 33 representative of the sensed pressure pulses. The processor 33 can be programmed to decode the information encoded in the pressure pulses. This information can be used to operate the damper module 10 so that the operation of the damper module can be controlled by the drilling operator. For example, the operator can vary the value of the thresholds at which the damping module will be actuated or deactivated by the processor 33. A pressure pulsation sensor suitable for use as the pressure pulsation sensor 31 is described in U.S. Pat. No. 6,105,690 (Biglin, Jr. et al.), which is incorporated by reference herein in its entirety.

Figure 2:
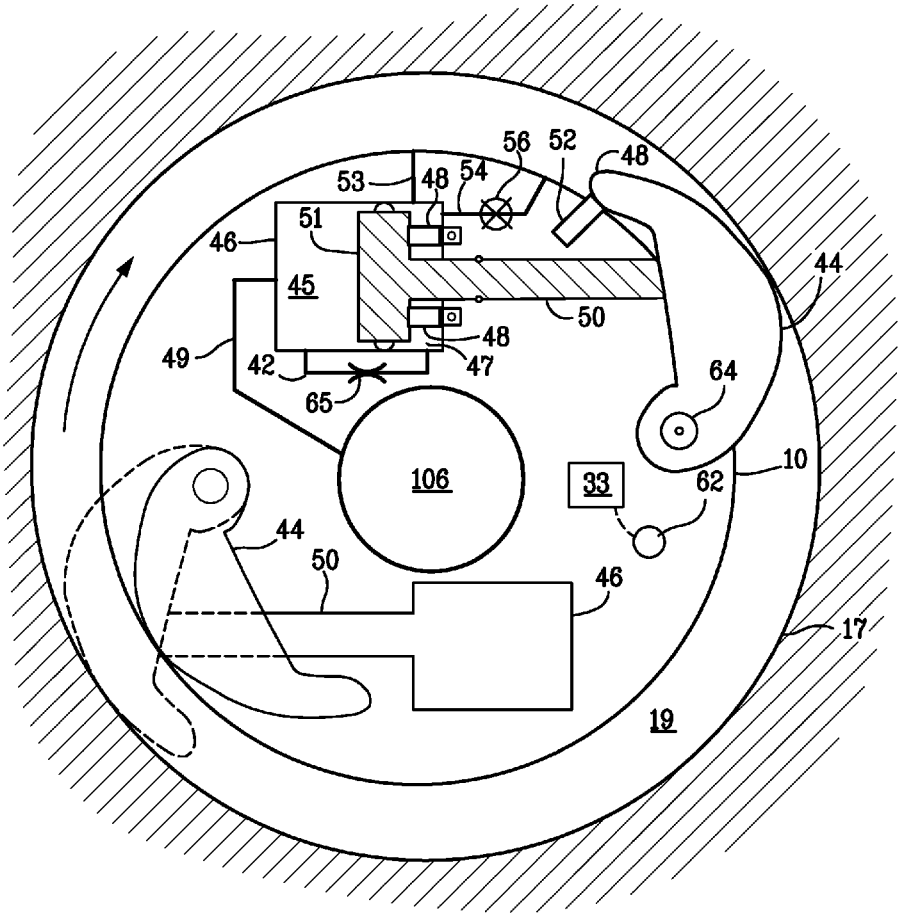
FIG. 2 is a transverse cross-section taken through the drill string shown in FIG. 1 at the location of the damping module.

A first embodiment of the torsional damping module 10 is shown in FIG. 2. The module 10 is coupled to the drill string 12 and rotates along with it. The module 10 comprises a chamber 46 in which one end 51 of a piston 50 is disposed. The other end of the piston 50 contacts a friction pad 44. The friction pad 44 pivots around pivot pin 64 so that extension of the piston 50 causes the friction pad 44 to extend radially outward by rotating around the pivot pin and engage the side of the bore hole 17 in the formation 16. A spring 52 is coupled to the friction pad 44 so as to bias the friction pad 44 into its retracted position. For purposes of illustration, FIG. 2 shows, in solid lines, a first friction pad 44 in its extended position, and, in dotted lines, a second friction pad 44 in its retracted position. However, as discussed further below, generally, all of the friction pads 44 in the damping module would extend or retract simultaneously. Also, although only two friction pad assemblies are shown in FIG. 2, more than two friction assemblies could be incorporated into each damping module. Preferably, each friction pad 44 is axially displaced from each other friction pad 44 in the damping module 10, although all the friction pads 44 could be located in the same plane if desired.

Drilling mud flowing from the mud pump 18 to the drill bit 13 flows through a central passage 106 in the damping module 10. As a result of the pressure drop due primarily to flow through the drill bit 13, the pressure of the mud in the passage 106 is considerably greater than the pressure of the mud in the annular passage 19, formed between the damping module 10 and the bore hole 17, through which drilling mud discharged from the drill bit 13 returns to the surface for recirculation. As a result, a large pressure differential exists between the drilling mud in the central passage 106 and annular passage 19. A passage 49 places the high pressure drilling mud in the central passage 106 in flow communication with a first portion 45 of the chamber 46, which is disposed on one side of the end 51 of the piston 50. A passage 42 places the chamber portion 45 in flow communication with a second portion 47 of chamber 46, which is disposed on the opposite side of the piston end 51 from chamber portion 45. An orifice 65 in passage 42 restricts the flow of mud between the chamber portions 45 and 47. Although a fixed orifice 65 is used in the preferred embodiment, an on-off valve or a variable flow control valve, operated by the processor 33, could be used instead, so that the flow of mud between the chamber portions 45 and 47 can be eliminated or adjusted. Passages 53 and 54 places chamber portion 47 in flow communication with annular passage 19. A valve 56 in passage 54, which is preferably a solenoid valve operated in response to signals from the processor 33, regulates the flow of mud from the chamber portion 47 to the annular passage 19. A pair of springs 48 biases the end 51 of piston 50 into the retracted position.

When no mud is flowing through the drill string 14, there is no pressure differential across the piston 50 and the spring 52 maintains the friction pad 44 in the retracted position to facilitate rotation and sliding of the drill string 12 into the bore hole 17. Unless the amplitude of the torsional vibration as determined by the processor 33 exceeds a threshold, the valve 56 remains closed.

When mud is flowing through the drill string but the valve 56 in passage 54 is closed, high pressure mud will flow through passage 49 from the central passage 106 to the chamber portion 45. From chamber portion 45, the mud will flow through passage 42 into chamber portion 47 and thence through passage 53 to the annular passage 19 for return to the surface. A pressure differential, the magnitude of which depends, among other things, on the difference in flow area between passages 42 and 53, is created across the end 51 of the piston 50, due to the difference in pressure between chamber portions 45 and 47. This pressure differential is such that a force $F_1$ acts on piston 50 which tends to drive the piston, and therefore, the friction pad 44 with which it is in contact, radially outward. On the other hand, springs 48, acting on piston 50, and spring 52, acting on friction pad 44, exert a combined force $F_2$ on piston 50 tending to drive the piston radially inward. Preferably, passage 53 is sized relative to the orifice 65 in passage 42 so that the relative rates of mud flow through passages 53 and 42 is such that the pressure differential across chamber portions 45 and 47 causes the extending force $F_1$ to be slightly greater than the retraction $F_2$ when mud is flowing through the drill string but valve 56 is closed. As a result, force $F_3$, which is the difference between forces $F_2$ and $F_2$, is applied to the friction pad 44. Since $F_3$ is relatively small, the friction pad 44 bears lightly against the wall of bore hole 17 when the drill string is in operation and mud is flowing therethrough but the torsional vibration does not exceed the threshold. The relatively constant light contact by friction pad 44 against the bore hole 17 when the drill string is in operation will not result in excessive wear on the friction pad nor appreciable retarding of the drill string angular velocity. However, it allows the friction pad 44 to be continuously deployed during operation of the drill string, and ready to respond quickly to high torsional vibration, while not exerting an appreciable force against the bore hole wall.

Since the friction pad 44 is continuously deployed against the wall of the bore hole 17, albeit lightly, the damping module 10 can very quickly apply a reverse torque to the drill string 12 to dampen torsional vibration. In particular, the friction pad 44 can exert a significant force on the bore hole wall very quickly because the time period required to move the friction pad from the retracted to extended position is eliminated since the friction pad is constantly maintained in the extended position during operation of the drill string.

When the processor 33 determines, based on information from the sensors 62, that the torsional vibration has exceeded a threshold, the valves 56 in the passages 54 are opened. The threshold may be a predetermined value or may be a variable, the value of which depends on operating conditions, such as the length of the drill string, the RPM of the drill string, etc. The opening of valve 56 increases the flow of drilling mud from chamber portion 47 to the annular passage 19, in which the pressure of the mud is considerably below that of the mud flowing in the central passage 106 due to, inter alia, the pressure drop through the drill bit 13 as previously discussed. The orifice 65 in passage 42 is sized so that the flow of mud to the annular passage 19 through passage 54 could be much greater than the flow of mud through passage 42 between the chamber portions 45 and 47. As a result, the opening of valve 56 generates a significant pressure differential across the end 51 of piston 50. This pressure differential generates sufficient extension force $F_1$ to considerably overcome the resistance of retracting force $F_2$ created by springs 48 and 52 so that a relatively large force $F_3$ drives the piston 50 against the friction pad 44. As a result, the friction pads 44 press against the wall of the bore hole 17 with considerable force, thereby generating a frictional drag force, which in turn creates a "reverse" torque—that is, a torque applied in a direction opposite to that of the torque applied to rotate the drill string so that the reverse torque opposes the rotation of the drill string. This "reverse" torque dampens the torsional vibration of the drill string 12.

Thus, when, after "sticking," the drill bit 13 "slips," thereby speeding up as the drill string 12 unwinds, the "reverse" torque created by the damping module 10 serves to attenuate the acceleration of the drill bit 13, thereby reducing the maximum angular velocity reached by the drill bit and, therefore, the amplitude of the attendant torsional vibration. Preferably, the processor 33 simultaneously sends signals that cause the valves 56 of the other friction pad assemblies in the damping module to similarly actuate.

It should be realized that the frequency of torsional vibration is typically relatively high. Thus, the damping module 10 is preferably capable of respond very quickly—e.g., within millisecond—to the sensing of excessive torsional vibration.

When the processor 33 determines that the torsional vibration has dropped below a threshold, which may be the same as the threshold for actuating the friction pads 44 or a different threshold, it deactivates the valve 56—that is, closes the valve 56—so that the pressure differential between the chamber portions 45 and 47 is again minimized. As a result, pressure differential across the end 51 of the piston 50 is minimized, causing the friction pad 44 to only lightly contact the borehole 17 wall as before.

Although as discussed above, the valve 56 is a solenoid valve that opens fully whenever an activation signal is received from the processor 33, a variable flow control valve could also be used. In this configuration, the processor is programmed to vary the flow through the valve 56, and thereby vary the force the friction pads 44 apply to the bore hole 17. This, in turn, allows the amount of damping created by the module 10 to be varied, depending on the level of the measured torsional vibration, or depending on the location of the damper module 10 along the length of the drill string 12.

Although in the embodiment discussed above, the friction pads 44 are actuated only when the valves 56 open in response to a determination by the processor 33 that the torsional vibration has exceeded a threshold, the vibration damping module could also be operated so that the friction pads 44 were always actuated and applying a significant force against the bore hole wall, for example, by dispensing with the valve 56. In this configuration, the damping module 10 would provide damping whenever mud was flowing, regardless of the level of torsional vibration.

Although in the embodiment discussed above, the passage 53 is used to create a relatively small pressure differential across the chamber portions 45 and 47 so as to continuously place the friction pad 44 in the extended position without exerting significant force against the bore hole wall, alternatively, passage 53 could be eliminated and valve 56 in passage 54 could be a flow control valve that varied the flow rate through passage 54 to maintain the relatively small pressure differential across chamber portions 45 and 47. In that configuration, a pressure sensor (not shown) could be used to measure the pressure of the drilling mud, or to directly measure the pressure differential across chamber portions 45 and 47, and such measurement provided to the processor 33. The processor 33 would be programmed with logic that allowed it to control the valve 56 so as to maintain the slight pressure differential across chambers 45 and 47 sufficient to maintain the friction pad 44 deployed but without exerting appreciable frictional drag.

Although in the embodiments discussed above, the passage 53 or the valve 56 is used to continuously place the friction pad 44 in the extended position, alternatively, the passage 53 could simply be eliminated and the valve 56 maintained closed during normal operation. In that case, the passage 42 equalizes the pressure of the drilling mud in chamber portion 45 with that in chamber portion 47 and the piston 50 is maintained in the retracted position during normal operation so as to minimize wear on the friction pad 44. In this embodiment, the friction pad 44 is only extended when the torsional vibration exceeds the threshold.

Although only one damping module 10 is shown in FIG. 1, a number of similar damping modules could be spaced throughout the drill string 12, preferably in the lower portion of the drill string. The damping modules 10 will then impart a reverse torque at discrete locations along the drill string 12. The processors 33 in each of the these damping modules could cause the friction pads 44 of each damping module to operate simultaneously, or each processor 33 could be programmed individually to respond to a different level of torsional vibration as measured at that module.

Although as discussed above, the piston 50 drives the friction member 44 radially outward against the wall of the bore hole 17, in an alternate embodiment, the pad 44 could be dispensed with, and the piston itself could be the friction member that contacts the bore hole wall to dampen torsional vibration. Also, although in a preferred embodiment, springs 48 and 52 are used to impart a retracting force on the piston 50, one or both of these springs could be dispensed with. If neither springs 48 or 52 are used, the force $F_3$ exerted on the wall of the bore hole 17 will be equal to the force $F_1$ generated by the piston 50.

As previously discussed, according to one aspect of the invention, the damping module may be controlled from the surface by the generation of pressure pulses in the mud, or by starting and stopping the drill string rotation. Alternatively, electromagnetic signals may be generated at the surface and received by an appropriate sensor in the BHA. Such down-linking allows the torsional vibration threshold level at which the device is actuated, or the magnitude of damping force applied when the device is actuated, to be varied by the drill rig operator. Further, it should be noted that the variation in angular velocity along the drill string 12 during stick-slip is greater nearer the drill bit 13 than near the surface. Thus, if a plurality of damping modules 10 are distributed along the length of the drill string 12, as discussed above, each module can be individually directed by the operator, using mud pulse telemetry, to adjust the damping force or torsional vibration threshold for that module. Thus, for example, a greater frictional drag force could be applied by the damping modules closer to the drill bit 13 than those farther away from the drill bit.

Figure 3:
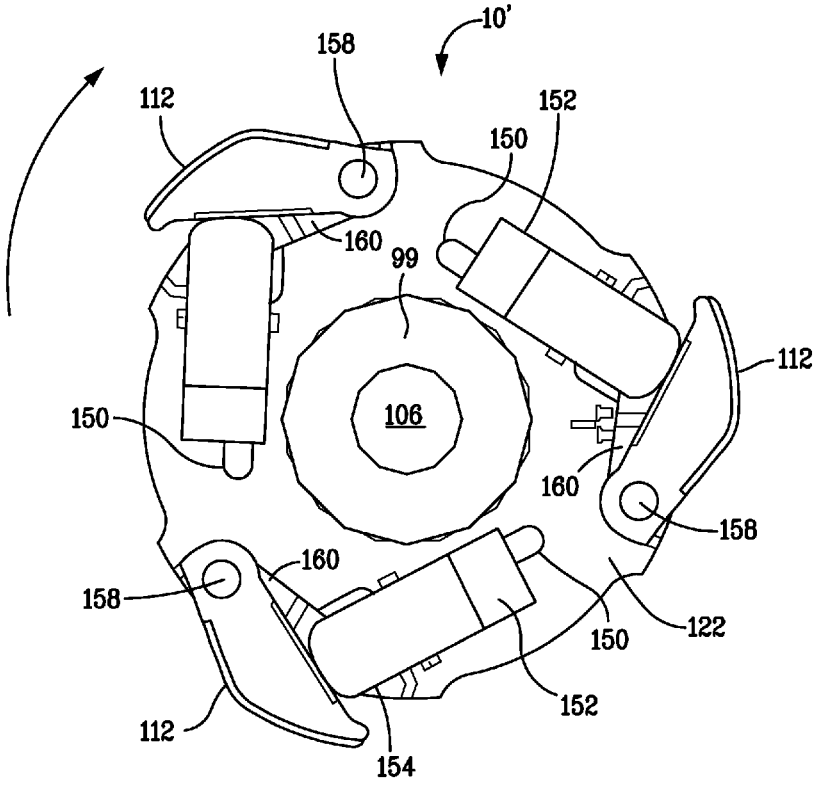
FIG. 3 is a view similar to FIG. 2 showing another embodiment of the damping module of the current invention.

A second embodiment of a damping module 10' according to the invention is shown in FIG. 3. This embodiment functions in a manner similar to embodiment 10 described above. Module 10' comprises a housing 122 through which extends a drive shaft 99 coupled to the module so that the module rotates with the drive shaft, which, in turn, is coupled to the drill string 12. The shaft 99 has a central passage 106 formed therein through which drilling mud flows as explained above. Passages 150 from a hydraulic system supply a hydraulic fluid that pressurizes cylinders 152 when valves in the hydraulic system (not shown) are activated by the processor 33 in response to high torsional vibration. The pressurization of the cylinders 152 actuates pistons 154, which causes friction pads 112 to rotate around pivot pins 158 and contact the bore hole 17, creating a damping force as explained above.

The system for actuating the pistons 154 is described more fully in U.S. Pat. No. 7,389,830, entitled "Rotary Steerable Motor System For Underground Drilling" (Turner et al.), herein incorporated by reference in its entirety, except that, to effect vibration damping, the pressurized hydraulic fluid is supplied to each cylinder 152 simultaneously, rather than sequentially to effect steering of the drill bit 13 as described in the aforementioned patent. Alternatively, the friction pads 112 of the module 10' could be actuated sequentially so as to effect steering according to the aforementioned patent, but overlayed with a uniform degree of outward force superimposed on these levels to effect damping—that is, the hydraulic fluid supplied to the cylinders 152 could be varied through each rotation of the module 10' so that, although each friction pad 112 is continuously in contact with the bore hole 17 during each 360° rotation of the module 10', the amplitude of the outward force the friction pads apply to the bore hole varies during each 360° rotation, as described in the aforementioned patent, so that the path of the drill bit 13 is altered. In this manner, the module 10' can effect both steering and damping, either at different times or simultaneously at the same time.

Figure 4:
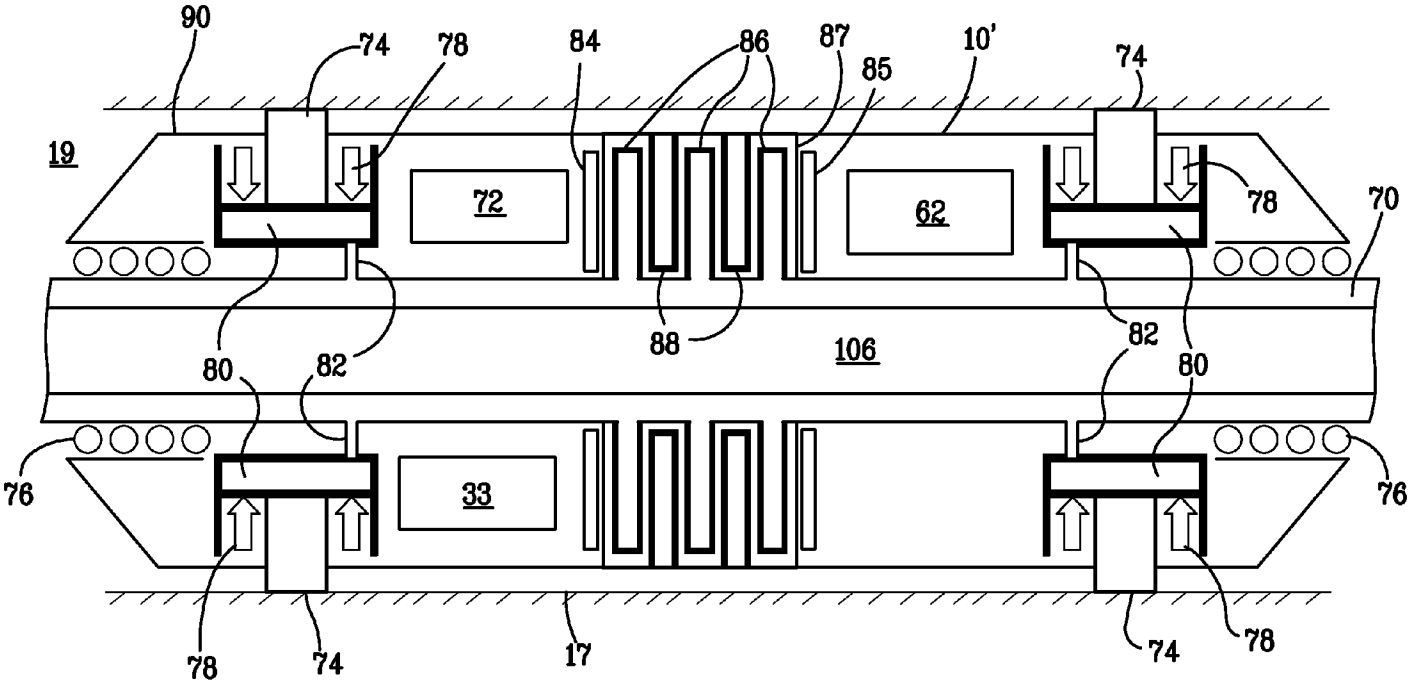
FIG. 4 is a longitudinal cross-section through another embodiment of a damping module according to the current invention.

A third embodiment of a torsional vibration damper 10" is shown in FIG. 4. The module 10" comprises a housing 90 that encloses a shaft 70. The shaft 70 is coupled to and rotates with the drill string 12 and is supported on bearings 76 on either side of the module housing 90. Drilling mud from the surface flows through the central passage 106 in the shaft 70, as discussed above. A plurality of piston chambers 80 are supported within the housing 90 and spaced around the circumference of the module 10 at fore and aft locations. A sliding piston 74 is supported within each chamber 80 and biased by springs 78 radially inward into a retracted position. The retraction of the pistons 74 facilitates sliding the drill string 12 into the bore hole 17 when the drill string is not rotating and no mud is being pumped through the drill string.

Passages 82 place the drilling mud flowing in the central passage 106 in flow communication with each of the chambers 80. Thus, whenever drilling is occurring, and drilling mud is flowing through the central passage 106, the pressure of the drilling mud in each chamber 80 drives the pistons 74 radially outward so that they contact the wall of the bore hole 17. Unlike the damping modules 10 and 10' discussed above, in this embodiment, the chamber 80 and piston 74 are sized so that sufficient force is generated by the pistons against the bore hole 17 to prevent any rotation of the housing 90 of the damping module 10", even when the pistons are reacting against the forces damping the torsional vibration, as discussed below. Thus, the pistons 74 act as anchors to prevent rotation of the housing 90.

A chamber 87 is mounted in the housing 90 and has seals acting against the outside diameter of the shaft 70 so that the chamber is sealed. A row of rotating blades 86 are coupled to the shaft 70 and circumferentially arrayed so that they extending radially outward from the shaft 70 within the chamber 87. A row of vanes 88 are mounted in the housing 90 and circumferentially arrayed so that they extend radially inward from the housing 90 within the chamber 87 and so that each row of vanes 88 is disposed between two rows of rotating blades 86, whereby an axial gap is formed between each of row of vanes and the adjacent rows of blades. Since the vanes 88 are mounted in the housing 90, and the pistons 74 prevent the housing from rotating, the vanes 88 are held stationary. Although three rows of blades 86 and two rows of vanes 88 are shown, a greater or lesser number of blades and vanes could also be utilized. Electromagnets 84 and 85 are positioned on either side of the chamber 87. The coils of the electromagnets 84, 85 are powered from a power source 72, such as a battery, under the control of the processor 33.

The chamber 87, including the axial gaps between the rows of blades 86 and vanes 88, is filled with a magnetorheological fluid (hereinafter referred to as "MR fluid"). MR fluids typically comprise non-colloidal suspensions of ferromagnetic or paramagnetic particles. The particles typically have a diameter greater than approximately 0.1 microns. The particles are suspended in a carrier fluid, such as mineral oil, water, or silicon. Under normal conditions, MR fluids have the flow characteristics of a conventional oil. In the presence of a magnetic field (such as the magnetic fields created by the electromagnets 84 and 85), however, the particles suspended in the carrier fluid become polarized. This polarization cause the particles to become organized in chains within the carrier fluid. The particle chains increase the fluid shear strength (and therefore, the flow resistance or viscosity) of the MR fluid. Upon removal of the magnetic field, the particles return to an unorganized state, and the fluid shear strength and flow resistance returns to its previous value. Thus, the controlled application of a magnetic field allows the fluid shear strength and flow resistance of an MR fluid to be altered very rapidly. MR fluids are described in U.S. Pat. No. 5,382,373 (Carlson et al.), which is incorporated by reference herein in its entirety. An MR fluid suitable for use in the damping module 10" is available from APS Technology of Cromwell, Conn.

During normal operation, no power is supplied to the coils of the electromagnets 84 and 85 so that the MR fluid offers little resistance to the rotation of the blades 86 relative to the stationary vanes 88. However, if the processor 33 determines that the torsional vibration has exceeded a threshold, the coils of the electromagnets 84, 85 are powered, thereby creating a magnetic field that increases the viscosity of the MR in chamber 87. The increased viscosity increases the flow resistance to which the blades are subjected, thereby creating a force that dampens the torsional vibration. Thus, instead of frictional resistance between pads 44, 112 and the bore hole 17 as in embodiments 10 and 10', discussed above, in the embodiment 10" fluid frictional resistance created internally within the module 10" is used to create a reverse torque that dampens torsional vibration. The greater the current supplied to electromagnets 84, 85, the stronger the magnetic field to which the MR fluid is subjected and, therefore, the greater the resistance imparted to the rotation of the blades 86 and the greater the damping force. Thus, by controlling the current to the electromagnets 84, 85, the processor 33 can vary the amount of damping applied to the drill string by the damping module 10".

Figure 5:
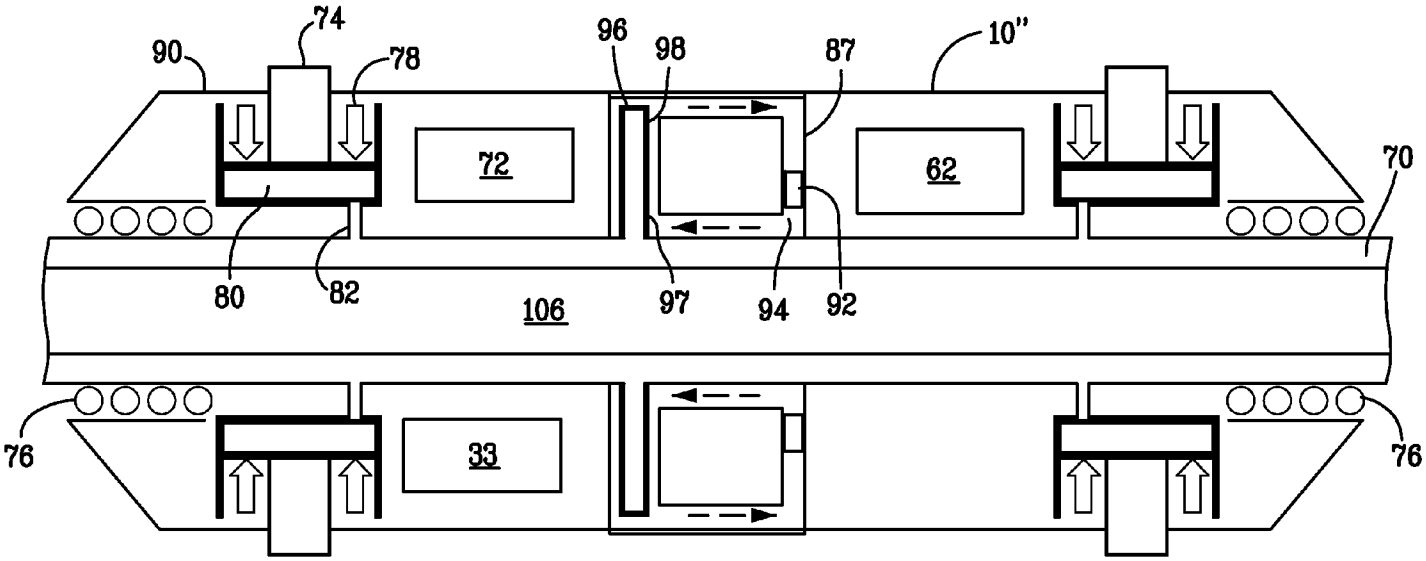
FIG. 5 is a view similar to FIG. 4 showing another embodiment of the damping module of the current invention.

A fourth embodiment of the damping module 10''' is shown in FIG. 5. This embodiment is similar to the embodiment 10" shown in FIG. 4 except that the chamber 87, which is maintained stationary within the housing 90, which in turn is maintained stationary by the pistons 74, contains an impeller 96 coupled to the shaft 70 for rotation therewith. A flow passage 94, which is filled with a fluid, connects the inlet 97 and outlet 98 of the impeller 96 so that the impeller acts as a pump that circulates fluid through the passage 94. A valve 92 in the flow passage 94 regulates the pressure drop in the passage. During normal operation, the valve 92 is fully open so that there is little fluid resistance to the flow of fluid through passage 94 and, therefore, little resistance to rotation of the impeller 96. However, when the processor 33 determines that the torsional vibration has exceeded a threshold, it closes the valve 92, thereby reducing the flow area of the passage 94 and creating additional resistance to the flow of fluid through the passage 94. This additional flow resistance to the rotation of the impeller 96, and therefore the rotation of the shaft 70 and the drill string of which it is a part, creates a force—that is, a reverse torque—that dampens the torsional vibration. The farther the valve 92 is closed, the greater the resistance imparted to the impeller 96 and the greater the damping force. Thus, by controlling the valve 92, the processor 33 can vary the amount of damping applied to the drill string by the damping module 10'''. It can be noted that, line the embodiment 10'', in the embodiment 10''' fluid frictional resistance created internally within the module 10''' is used to create a reverse torque that dampens torsional vibration.

Figure 6A:
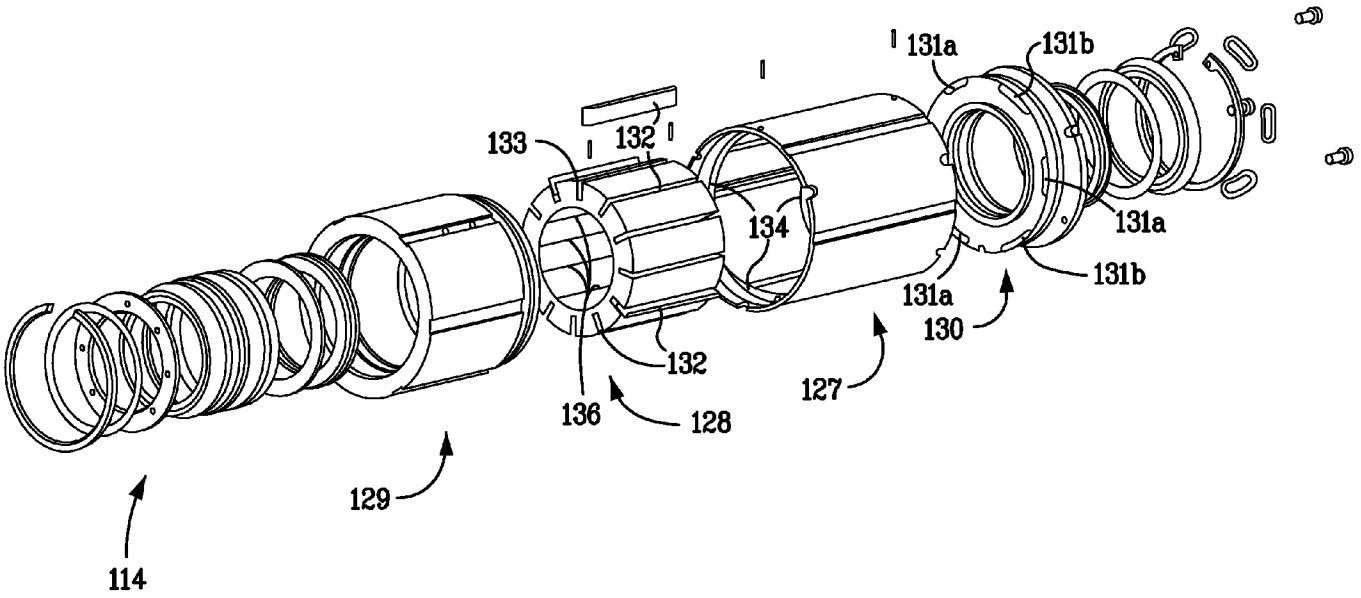
FIGS. 6A is an exploded view, and 6B and C are longitudinal and transverse cross-sections, respectively, of an alternate embodiment of a pump for use in the damping module shown in FIG. 5.
Figure 6B:
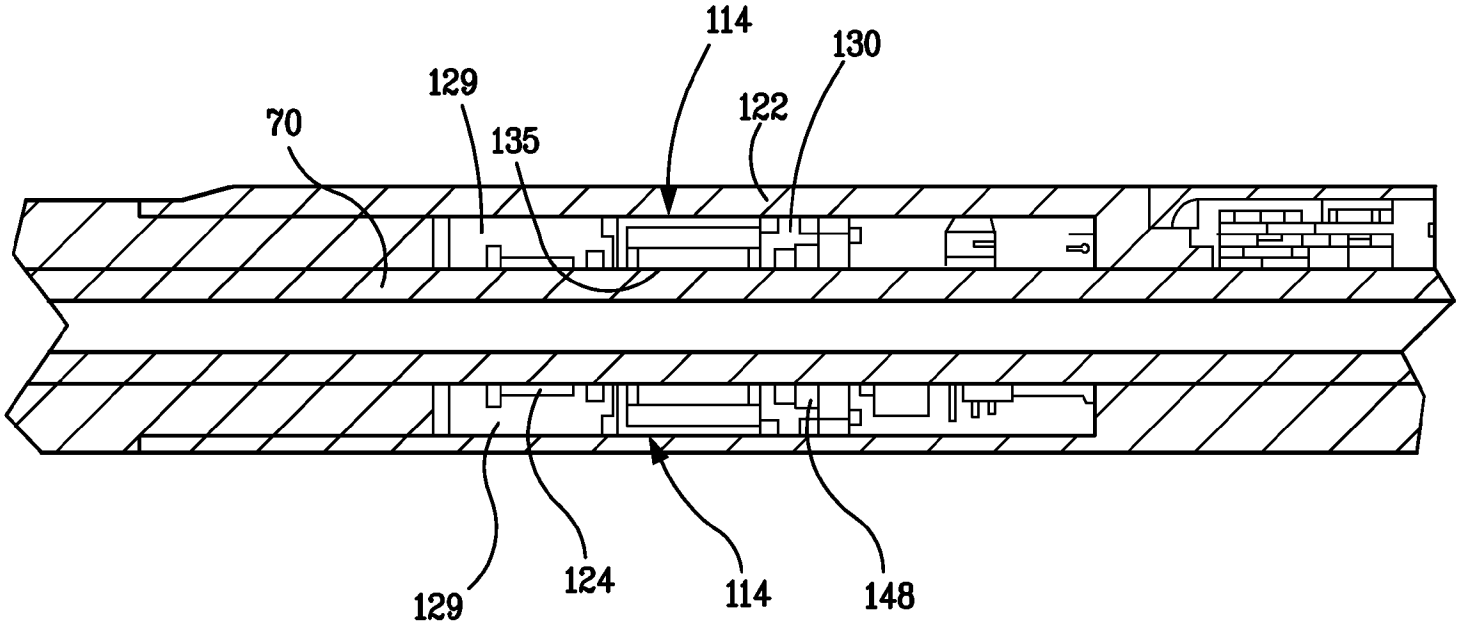
Figure 6C:
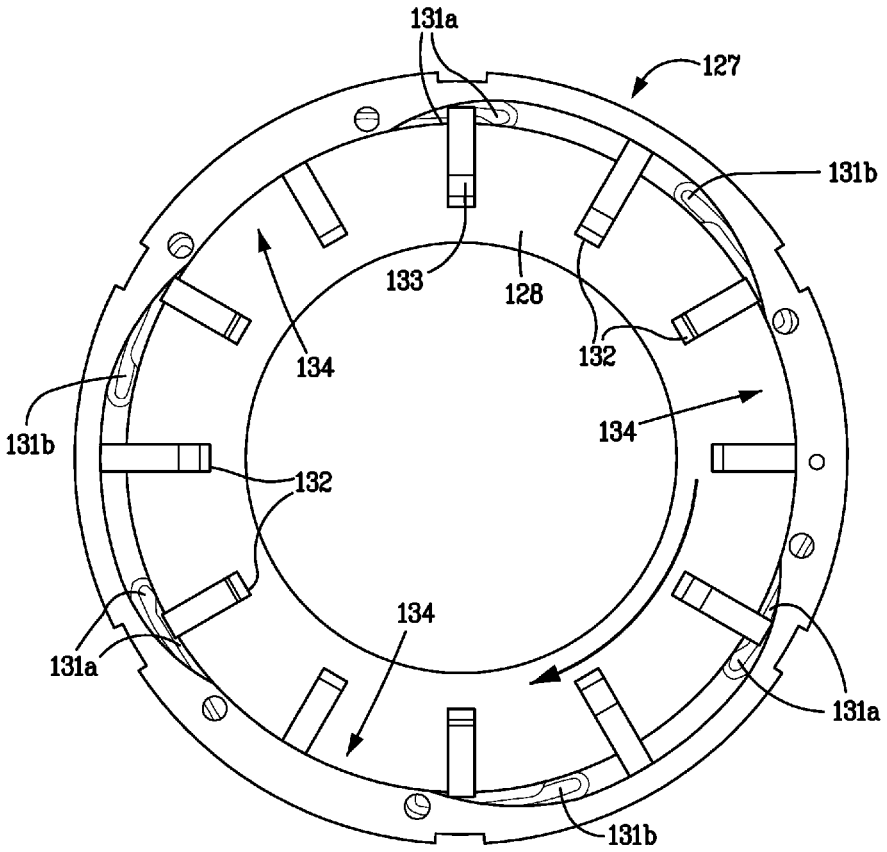

FIGS. 6A, B and C show an alternate embodiment of the pump in the damping module 10''' shown in FIG. 5. The pump 114 shown in FIG. 6 is a positive displacement pump, instead of an impeller type pump as shown in FIG. 5, and is preferably a hydraulic vane pump, as shown in FIGS. 6A, 6B and 6C and described in U.S. Pat. No. 7,389,830, previously incorporated by reference herein. The pump 114 comprises a stator 127, and a rotor 128 disposed concentrically within the stator 127. The pump 114 also comprises a bearing seal housing 129 secured to a down-hole end of the stator 127, and a manifold 130 secured to an up-hole end of the stator 127. Bearings are disposed concentrically within a bearing seal housing 129. The rotor 128 is rotated in relation to the stator 127 by drive shaft 70, shown in FIG. 6B, which is coupled to the drill string for rotation therewith. Bearings 124 substantially center the drive shaft 70 within a housing 122, while facilitating rotation of the drive shaft 70 in relation to the housing 122. The pump 114, housing 122, and the drive shaft 70 are substantially concentric. The stator 127, bearing seal housing 129, and manifold 130 of the pump 114 are restrained from rotating in relation to the housing 122, and preferably are prevented from rotating by anchoring the housing 122, to which they are coupled, to the bore hole wall, as previously discussed in connection with housing 90 shown in FIGS. 4 and 5.

The manifold 130 has three inlet ports 131*a*, and three outlet ports 131*b* formed therein. Fluid, which may be a suitable high-temperature, low compressability oil such as MOBIL 624 synthetic oil, enters the hydraulic pump 114 by way of the inlet ports 131*a*. Spring-loaded vanes 132 are disposed in radial grooves 133 formed in the rotor 128. Three cam lobes 134 are positioned around the inner circumference of the stator 127. The cam lobes 134 contact the vanes 132 as the rotor 128 rotates within the stator 127. The shape of the cam lobes 134, in conjunction with the spring force on the vanes 132, causes the vanes 132 to retract and extend into and out of the grooves 133.

Each vane 132 moves radially outward as it rotates past the inlet ports 131*a*, due to the shape of the cam lobes 134 and the spring force on the vane 132. This movement generates a suction force that draws oil through the inlet ports 131*a*, and into an area between the rotor 128 and the stator 127. Further movement of the vane 132 sweeps the oil in the clockwise direction, toward the next cam lobe 134 and outlet port 131*b*. The profile of the cam lobe 134 reduces the area between the rotor 128 and the stator 127 as the oil is swept toward the outlet port 131*b*, and thereby raises the pressure of the oil. The pressurized oil is forced out of pump 114 by way of the outlet port 131*b*.

The use of a hydraulic vane pump such as the pump 114 is described for exemplary purposes only. Other types of hydraulic pumps that can tolerate the temperatures, pressures, and vibrations typically encountered in a down-hole drilling environment can be used in the alternative. For example, the pump 114 can be an axial piston pump in alternative embodiments.

The pump 114 is driven by the drive shaft 70. In particular, the portion of the drive shaft 70 located within the rotor 128 preferably has splines 135 formed around an outer circumference thereof. The spines 135 extend substantially in the axial direction. The splines 135 engage complementary splines 136 formed on the rotor 128, so that rotation of the drive shaft 70 in relation to the housing 122 imparts a corresponding rotation to the rotor 128. The use of the axially-oriented spines 135, 136 facilitates a limited degree of relative movement between the drive shaft 70 and the rotor 128 in the axial direction. This movement can result from factors such as differential thermal deflection, mechanical loads, etc. Permitting the rotor 128 to move in relation to the drive shaft 70 can reduce the potential for the pump 114 to be subject to excessive stresses resulting from its interaction with the drive shaft 70. A ball bearing 148 is concentrically within on the manifold 130. The bearing 148 helps to center the drive shaft 70 within the pump 114, and thereby reduces the potential for the pump 114 to be damaged by excessive radial loads imposed thereon by the drive shaft 70. The bearing 148 is lubricated by the oil in a hydraulic circuit.

Figure 7:
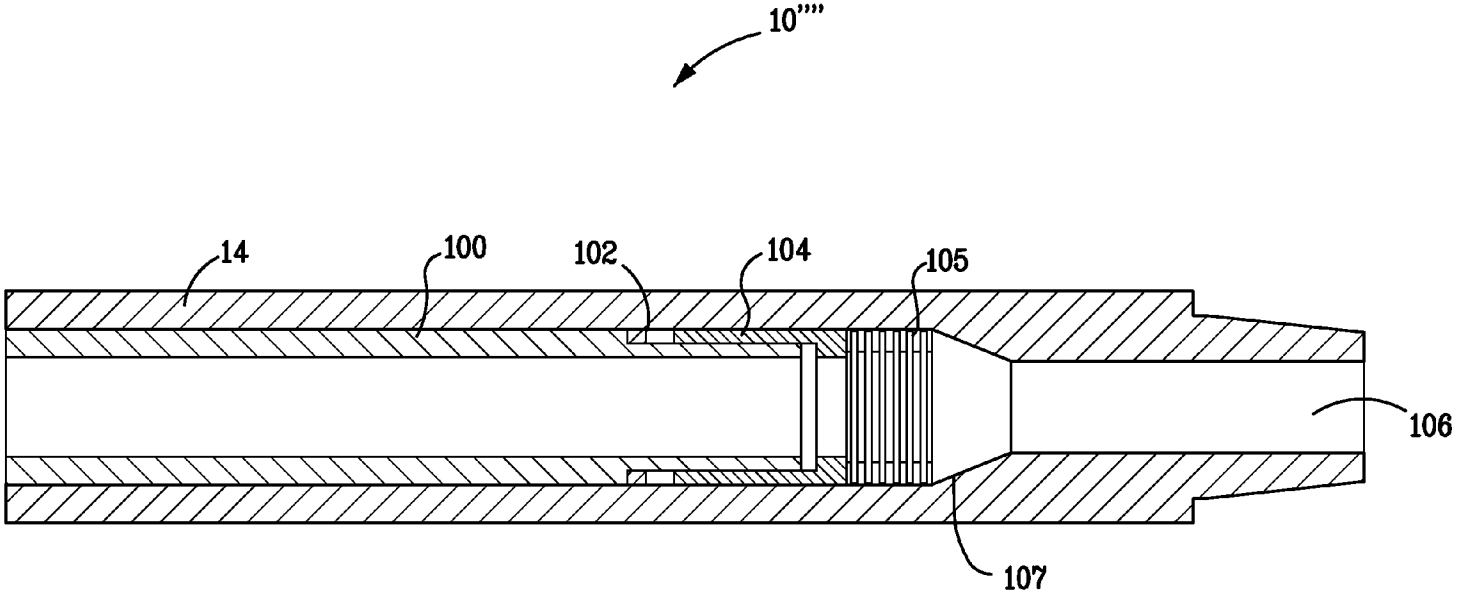
FIG. 7 is a longitudinal cross-section through a portion of the drill collar shown in FIG. 1 showing another embodiment of the damping module according to the current invention.

A fifth embodiment of the damping module 10' is shown in FIG. 7. This is a passive damper concept and is similar in theory to devices used for coupling rotating machinery. The concept uses a cylindrical internal mass 100 located within and coupled to the drill collar 14 by means of a threaded bushing 104. The threaded bushing 104 is keyed to the drill collar 14 and, therefore, rotates with the drill collar, which in turn rotates with the drill string 12. A bearings 102 mounted in the drill collar 14 supports the mass 100 radially and axially so that the mass can rotate with respect to the drill collar 14 and threaded busing 104. One end of the mass has male threads and the busing 104 has mating female threads so that the mass and bushing are threaded together. This allows drill collar 14 to rotate with respect to the mass 100. A Belleville spring stack 105 is located between the end of the bushing 104 and a wall 107 formed in the drill collar 14.

When the drill collar 14 begins to accelerate rotationally, for example as a result of stick-slip, the inertia of the mass 100 resists the rotational acceleration. Therefore, the mass 100 rotates at a lower rotational velocity than the drill collar 13, at least initially. The difference in rotational velocity between the drill collar 14 and the mass 100 causes the threaded bushing 104 to be axially displaced, to the right in FIG. 7, with respect to the drill collar 14—that is, the bushing 104 begins to "unscrew" from the mass 100. This displacement causes the threaded bushing 104 to compress the spring stack 105, resulting in an applied torque opposite to the direction of the increase in collar speed. The helix angle associated with the threads in the bushing 104 cause the inertial resistance of the mass 100 to apply a torque on the drill collar 14 that resists acceleration and thereby dampens torsional vibration. Thus, the effect of the mass 100 is to effectively retard the acceleration of the drill string 12 when the stuck drill bit 13 "slips." As the drill collar 14 reaches its maximum speed and begins to de-accelerate, the inertia of the mass 100 then applies torque in the opposite direction, reducing the rate of de-acceleration. Thus, any-time there is a change in speed of the drill collar 14, the mass 100 applies a torque in the opposite direction, effectively damping torsional vibration.

Although Belleville springs are shown in connection with this embodiment, other types of springs, such as a helical spring or a torsional spring, could also be used.

Figure 8:
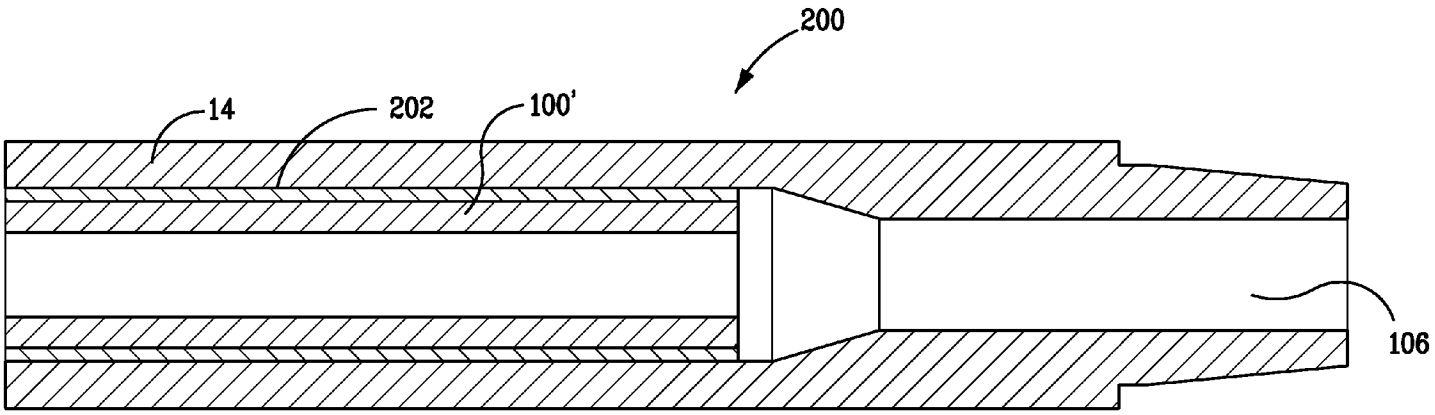
FIG. 8 is a view similar to FIG. 7 showing another embodiment of the invention is which the damping module dampens lateral vibration.

FIG. 8 shows another embodiment of the invention in which a damping module 200 is used to damp lateral vibration, including whirling. Lateral vibration causes the drill collar 14 to cyclically flex and move laterally. According to this embodiment, the cylindrical internal mass 100' is coupled to the drill collar 14 by means of layer of elastomer 202 bonded to both the drill collar 14 and the mass. Preferably, the elastomer 202 is a rubber of the type having excellent damping characteristics.

The drill collar 14 flexes during lateral vibration, resulting in relative displacement between the drill collar 14 and the cylindrical internal mass 100'. This relative displacement causes the layer of elastomer 202 to undergo strain. The hysteresis of the layer 202 dampens the lateral vibration. In the event of whirling, in which the drill collars 14 precesses around the bore hole 17, the mass 100' deflects laterally, straining the layer 202, resulting in damping.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed:

1. A method of damping torsional vibration in a drill string having a drill bit and a bottom hole assembly spaced from the drill bit in an uphole direction, the drill bit configured to drill a bore hole through an earthen formation, the method comprising the steps of:

applying a torque to said drill string in a first rotational direction so as to cause said drill string to rotate in said first rotational direction;

extending at least one member carried by the bottom hole assembly from a retracted position to a fully extended position where the at least one member extends outward with respect to the bottom hole assembly;

sensing, via a sensor carried by the bottom hole assembly, the value of a parameter that is indicative of the presence of torsional vibration in said drill string;

comparing, via a processor in communication with the sensor, said value of said parameter to a predetermined threshold of torsional vibration;

applying a reverse torque to said drill string via the at least one member to dampen the torsional vibration when 1) the at least one member is in the fully extended position, and 2) said value of said parameter exceeds said predetermined threshold, wherein said reverse torque acts in a second rotational direction that is opposite to said first rotational direction and exerts a force against a wall of said bore hole so as to dampen said torsional vibration;

wherein the extending step occurs when said value of said parameter indicative of torsional vibration does not exceed said predetermined threshold so that the time required to cause said at least one member to exert said force against said bore hole wall when said parameter exceeds said predetermined threshold is shortened.

2. The method according to claim 1, wherein said step of applying the reverse torque is applied to said drill string includes imposing frictional resistance to the rotation of said drill string in said first rotational direction sufficient to dampen said torsional vibration of said drill string.

3. The method of claim 2, wherein the drill string includes a central passage, the bottom hole assembly includes a chamber, a first passage and a second passage, the first passage extending from the central passage to the chamber and the second passage extending from the chamber to an outer surface of the bottom hole assembly, wherein the step of causing the at least one member to exert the first force is in response to a differential pressure between 1) drilling mud flowing through the central passage, and 2) drilling mud flowing along the outer surface of the bottom hole assembly.

4. The method according to claim 1, wherein the step of extending the at least one member to the fully extended position occurs when said drill string is operated for a first period of time, such that said at least one member applies an initial force against the wall of said bore hole that does not appreciably resist the rotation of said drill string in said first rotational direction, and the initial force is less than the force that applies the reverse torque to said drill string, and wherein the step of applying the reverse torque occurs during a second period of time that is subsequent to the first period of time.

5. The method according to claim 1, wherein said at least one member transitions from the retracted position into the extended position by rotating about a pivot.

6. The method according to claim 1, wherein the step of extending said at least one member into the extended position comprises overcoming a spring force biasing said at least one member radially inwardly.

7. The method according to claim 1, wherein the step of exerting the force on said bore hole wall comprises varying the magnitude of said force exerted on said bore hole wall in response to a change in the value of said parameter sensed via the sensor during rotation of the drill string.

8. The method according to claim 1, wherein the force is a first force, further comprising the step of flowing drilling mud through a central passage that extends along a length of said drill string into at least one additional passage defined by the bottom hole assembly, the at least one additional passage being in flowing communication with the central passage and the at least one member, and wherein the pressure of said drilling mud in the central passage and the at least one additional passage creates a second force that causes the at least one member to exert said first force on said bore hole wall.

9. The method according to claim 8, wherein said first force is substantially equal to said second force.

10. The method according to claim 8, wherein a spring force biases said at least one member radially inward into the retracted position.

11. The method according to claim 8, wherein the at least one member is a first member and a second member, wherein the pressure of said drilling mud creates said second force causing said second member to exert said first force on said bore hole wall by directing at least a portion of said drilling mud through the at least one additional passage to the first member.

12. The method according to claim 11, wherein the first member is a piston that drives said second member radially outwardly.

13. The method according to claim 11, wherein said second member comprises a pivotable member.

14. The method according to claim 1, wherein the predetermined threshold is a first threshold, further comprising the step of ceasing applying said reverse torque when said parameter drops below a second threshold.

15. The method according to claim 14, wherein said second threshold is different from said first threshold.

16. The method according to claim 14, wherein said second threshold is substantially the same as said first threshold.

17. The method according to claim 1, wherein the value of said predetermined threshold varies depending on the operating conditions of said drill string.

18. The method according to claim 1, wherein said parameter comprises the rotational velocity of said drill string at at least one location along the length of said drill string.

19. The method according to claim 1, wherein said parameter comprises the variation in the substantially instantaneous angular velocity of at least a portion of said drill string over a period of time.

20. The method according to claim 1, wherein the step of applying the reverse torque to said drill string further comprises applying said reverse torque at a plurality of discrete locations along said drill string.

21. The method according to claim 20, wherein the value of said reverse torque applied at said plurality of discrete locations along said drill string varies among said discrete locations.

22. An apparatus configured to dampen torsional vibration in a drill string, the drill string being elongate along a longitudinal direction and being rotatable along a first rotational direction, the drill string having a drill bit for drilling a bore hole through an earthen formation, the apparatus comprising:

a module defining an outer surface and an opposed inner surface, the inner surface defining a central passage that extends along the longitudinal direction so as to permit a drilling mud to pass therethrough, the module including a chamber and at least one member in the chamber, the at least one member configured to transition between a) a first retracted configuration where the at least one member is at least partially disposed in the chamber, b) a second extended configuration where the at least one member extends extend radially outward beyond the outer surface of the module to apply a first force along a direction that is perpendicular to the longitudinal direction, and c) a third extended configuration where the at least one member extends radially outward beyond the outer surface of the module to apply a second force along the direction, the second force being greater than the first force, wherein the at least one member transitions between the first retracted configuration, the second extended configuration, and the third extended configuration when the module is coupled to the drill string and the drill string is drilling the bore hole, the module including a sensor configured to obtain the value of a parameter that is indicative of the presence of torsional vibration in said drill string when the module is coupled to the drill string and the drill bit is drilling into earthen formation, and the module further including a processor in communication with the sensor, the processor configured to, in response to the sensor obtaining of the value of the parameter that indicates the presence of torsional vibration, cause the at least one member to transition from the second extended configuration into the third extended configuration so as to apply a reverse torque to said drill string uphole from the drill bit when said value of said parameter exceeds a threshold, wherein said reverse torque acts in a second rotational direction that is opposite to said first rotational direction in order to dampen said torsional vibration when the drill string is drilling into the earthen formation.

23. The apparatus according to claim 22, the at least one member is configured to impose a frictional resistance to a wall of the bore hole when the drill string is rotated in said first rotational direction that is sufficient to create said reverse torque that dampens said torsional vibration of said drill string.

24. The apparatus according to claim 23, the at least one member is configured to exert a first force against the wall of said bore hole during rotation of the drill string.

25. The apparatus according to claim 24, wherein said at least one member is rotatable about a pivot.

26. The apparatus according to claim 24, wherein the processor is configured to determine when the value of the parameter exceeds the threshold, and in response to the determination, cause the at least one member to extend from a first retracted position to a second extended position that is radially outward from the first retracted position.

27. The apparatus according to claim 26, wherein the module further includes a biasing member that is configured to apply a biasing force that retracts the at least one member into the first retracted position.

28. The apparatus according to claim 24, wherein the at least one member is a first member received by the chamber, and a second member engaged with the first member, the second member extending radially outward from the outer surface of the module.

29. The apparatus according to claim 28, wherein the first member is a piston, and the second member is a pivotable pad, wherein the first member is moveable along a first direction transverse to the longitudinal direction to pivot the pad so as to apply the reverse torque to the drill string.

30. The apparatus according to claim 24, wherein the processor is configured to vary the magnitude of said first force exerted on said bore hole wall in response to a change in the value of said parameter obtained by the sensor.

31. The apparatus according to claim 22, wherein said parameter comprises the rotational velocity of said drill string at at least one location along the length of said drill string.

32. The apparatus according to claim 22, wherein said parameter sensed by said sensor comprises the variation in the substantially instantaneous angular velocity of at least a portion of said drill string over a period of time.

33. The apparatus according to claim 22, wherein the module includes a chamber, a first passage and a second passage, the first passage extending from the central passage to the chamber and the second passage extending from the chamber to an outer surface of the bottom hole assembly, wherein the central passage and the first and second passages are configured to receive a drilling mud.

34. The apparatus according to claim 22, wherein the module is configured such that the at least one member is moveable into an extended position relative to outer surface of the module, wherein the module is configured to apply a first level of force to the at least one member when in the extended position when the parameter indicative of torsional vibration does not exceed the first threshold, and a second level force that is greater than the first level of force when the parameter indicative of torsional vibration exceeds the first threshold.

35. The apparatus according to claim 34, further comprising a valve disposed in the additional passage and being electronically connected to the processor, the processor is configured to, in response to 1) an indication of the presence of drilling mud in the central passage, and 2) an indication that the value of the parameter indicative of torsional vibration does not exceed the first threshold, maintain the valve in a closed configuration, thereby causing application of the first level of force to the at least one member.

36. The apparatus according to claim 35, wherein the processor is configured to, in response to 1) an indication of the presence of drilling mud in the central passage, and 2) an indication that the value of the parameter indicative of torsional vibration exceeds the first threshold, causing the valve to open, thereby causing application of the second level of force to the at least one member.

* * * * *